United States Patent [19]

Wettengel et al.

[11] Patent Number: 4,828,508

[45] Date of Patent: May 9, 1989

[54] EXPLOSION PROTECTED SOCKET AND LAMP FOR DOUBLE BASE FLUORESCENT LAMPS

[75] Inventors: Lothar Wettengel; Hurbert Lung, both of Künzelsau, Fed. Rep. of Germany

[73] Assignee: Robert Wagner, Donzdorf, Fed. Rep. of Germany

[21] Appl. No.: 67,248

[22] Filed: Jun. 26, 1987

[30] Foreign Application Priority Data

Jul. 1, 1986 [DE] Fed. Rep. of Germany ..... 3621960

[51] Int. Cl.[4] ..... H01R 33/02

[52] U.S. Cl. ..... 439/235; 439/136; 439/259; 439/367; 439/188

[58] Field of Search ..... 439/347, 304, 188, 259, 439/612, 372, 226–244, 131, 135–147, 149, 310, 367; 362/260, 268–275, 277, 216, 219, 225

[56] References Cited

U.S. PATENT DOCUMENTS

| | | | |
|---|---|---|---|
| 2,356,601 | 8/1944 | McCarthy | 439/236 |
| 2,569,662 | 10/1951 | Fallek | 439/372 |
| 2,690,543 | 9/1954 | Mackensen | 439/372 |
| 3,436,716 | 4/1969 | Amis, Jr. et al. | 439/136 |
| 3,692,994 | 9/1972 | Hirschman et al. | 362/263 |
| 4,283,102 | 11/1981 | Richier | 439/188 |

FOREIGN PATENT DOCUMENTS

| | | | |
|---|---|---|---|
| 0485212 | 10/1929 | Fed. Rep. of Germany | 439/232 |
| 3402376 | 8/1985 | Fed. Rep. of Germany . | |
| 627556 | 8/1949 | United Kingdom | 439/232 |

*Primary Examiner*—David Pirlot

*Attorney, Agent, or Firm*—Spencer & Frank

[57] ABSTRACT

An explosion protected socket of the ignition protected type for double pin base fluorescent bulbs including a protected clamping device for securing the socket pins against coming loose and associated electrical connecting structure configured so that a receiving element provided with insertion openings for the socket pins is mounted to be movable within limits in the socket housing. The clamping device is coupled to an actuating device which becomes active jointly for both socket pins. A locking device which is positively coupled to the clamping device is disposed at the receiving element and is equipped with at least one locking element which is movable between an active position and an inactive position to hold the socket pins at a predetermined safety distance from voltage carrying parts of the electrical connecting structure. The locking element is automatically controlled by a sensing device in the locking device so that the locking element, which is moved to its inactive position if the clamping device is released, is held in its active position if the clamping device is not released and socket pins are absent or in an improper position.

23 Claims, 7 Drawing Sheets

2
44
1
59
28
29
27
50
48
51
49
VIII
56
57
55
7

49
52
50
54
53
51

EXPLOSION PROTECTED SOCKET AND LAMP FOR DOUBLE BASE FLUORESCENT LAMPS

BACKGROUND OF THE INVENTION

The present invention relates to an explosion protected socket of the ignition protected type Ex e "increased safety" for double pin base fluorescent bulbs, including a clamping device which will not permit the bulb pins or wires to come loose and is secured to hold the bulb pins and electrical connecting means associated therewith. The invention further relates to an explosion protected lamp of the ignition protected type Ex e "increased safety" equipped with a fluorescent bulb cover which can be opened, with the lamp having at least two sockets.

Any electrical apparatus that is to be used in an hazardous area must comply with the provisions of Standards which regulate the design and test requirements for said electrical apparatus to prevent ignition of the surrounding potentially explosive atmosphere by said apparatus. Typically, these Standards determine a number of different types of protection, and the present disclosure of the invention refers to the European Standards EN 50 014 to 50 020, 50 028 and 50 029, where these individual types of protection a described in detail. These Standards are harmonized within the sphere of CENELEC and in the Federal Republic of Germany have the designation DIN EN 50 014/VDE 0170/0171, Part 1, to DIN EN 50 020/VDE 0170/0171, Part 7, 9 and 10. Besides these Standards, the previous West German VDE Specifications 0170/0171/2.61 with Amendments continue to apply provisionally.

Specifically the Safety Regulations governing electrical apparatus for potentially explosive atmospheres of the type Ex "e" "increased safety" are the subject matter of DIN EN 50 019/VDE 0170/0171, Part 6. "Increased safety" "e" is defined as being a type of protection by which measures are applied so as to prevent with a major decree of security the possibility of excessive temperatures and of the occurance of arcs and sparks in the interior and on the external parts of electrical apparatus which does not produce them in normal service.

European Standard DIN EN 50 017/VDE 0170/0171, Part 4, contains the specific requirements for the construction and testing of "powder-filled" electrical apparatus, type of protection Ex "q". Powder-filling Ex "q" is a type of protection in which the enclosure of electrical apparatus is filled with a material in a finely granulated state so that, in the intended conditions of service, any arc occurring within the enclosure of said electrical apparatus, will not ignite the surrounding atmosphere.

European Standard DIN EN 50 016/VDE 0170/0171, Part 3, defines the specific requirements for the design and testing of "pressurized apparatus", type of protection Ex "p". Ex "p" is a type of protection by which the entry of a surrounding atmosphere into the enclosure of an electrical apparatus is prevented by maintaining inside said enclosure a protective gas at a higher pressure than that of the surrounding atmosphere.

European Standard DIN EN 50 018/VDE 0170/0171, Part 5, defines the specific requirements for the construction and testing of electrical apparatus with "flame-proof enclosure", type of protection Ex "d". Ex "d" is a type of protection in which the parts which can ignite an explosive atmosphere are placed in an enclosure which can withstand the pressure developed during an internal explosion of an explosive mixture and which prevents the transmission of the explosion to the explosive atmosphere surrounding said enclosure etc.

In plants in which there exists the danger of explosion, fluorescent bulbs are generally employed which have single—pin bases and correspondingly designed bulb sockets. Such special fluorescent lamps with single-pin bases are relatively expensive and not always obtainable. Attempts have therefore been made to construct lamps that meet the ignition protected type Ex e "increased safety" requirements and which are equipped to accommodate normal double pin base fluorescent bulbs. Thus, instead of the older fluorescent bulbs having a diameter of 38 mm, modern fluorescent bulbs having a diameter of 26 mm can also be used which, particularly in comparison with single-pin base fluorescent bulbs, have the advantage of greater light yield. For example, FRG-AS No. 2,512,991 discloses an explosion-proof socket for fluorescent bulbs having double-pin bases, this socket including a rotationally securely encapsulated contact area for closing the circuit of the lamp. A pressure tight encapsulated contact area in the sense of VDE 0171, however, requires considerable structural expenditures, especially when, as in the above described socket, the socket housing is made of insulating material and includes a rotatable socket insert equipped with metal contact springs to accommodate the pins of the fluorescent bulb. The individual elements must then be produced within close tolerances so as to meet the requirements of the standards for ensuring the necessary resistance to instantaneous ignition.

This lamp has receiving devices for making contact and holding the socket pins of a double-pin base fluorescent bulb in which these receiving devices are configured as positively retained and secured clamping devices for the socket pins, with a corresponding current supply being provided. Each socket pin has a terminal clamp which secures it against loosening and which, due to its particular configuration, always ensures sufficient contact pressure and meets the requirements for electrical equipment used in areas endangered by explosion. This ensures that, during operation, no ignitable sparks or arcs can occur at the point of connection so that pressure-tight encapsulated contact chambers etc. can be omitted. The reference, however, does not contain any mention of how a socket for double-pin base fluorescent bulbs is to be structurally designed to realize this general idea.

SUMMARY OF THE INVENTION

It is therefore an object of the invention to provide an explosion protected socket of the ignition protected type Ex e "increased safety" for double-pin base fluorescent bulbs and a lamp equipped with such sockets and corresponding to this ignition protected type which, though simple in construction, is distinguished by high operating safety.

This problem is solved by providing the above-mentioned socket having a receiving element which is movably mounted within limits in the socket housing, the socket being equipped with insertion openings for the socket pins and with electrical connecting and clamping devices. The clamping devices are coupled with an actuating device which acts jointly on both socket pins;

a locking device positively coupled with the clamping device is disposed at the receiving element and is equipped with at least one locking element which can be moved between an active and an inactive position. When this locking device is in the active position, it holds the socket pins at a predetermined safety distance from voltage carrying parts of the electrical connecting means and the locking element is automatically controlled by means of sensors disposed in the locking device which respond to the position of the socket pins relative to the clamping device so that the locking element, which is moved into its inactive position when the clamping device is released, is held in its active position in the absence of socket pins or with the socket pins in an improper position.

With this explosion protected socket, it is ensured that the two socket pins of the double-pin base fluorescent bulb are always held jointly by clamping devices in a manner secure against coming loose—if the bulb is inserted properly. In this way, it is not possible that, perhaps inadvertently, only one socket pin is clamped in and ignitable sparks could develop at the other socket pin. If, on the other hand, the fluorescent bulb is not inserted properly in the socket when the actuating device for the clamping device is actuated, for example in that the socket pins do not extend completely into the insertion openings or perhaps the receiving element has been placed next to the insertion openings, the locking element prevents the socket pins from subsequently coming in contact with current carrying parts of the electrical connecting device. Consequently it is ensured that voltage can be applied to the socket pins only after they have been properly clamped in and fixed by the clamping device.

Particularly simple structural conditions result if the clamping device for each socket pin includes a contact spring which forms part of the electrical connecting device and which, in operation, clamps the socket pin in a secure position. Both contact springs are coupled with a common actuating member of the actuating device. The contact springs are here configured in such a manner that they meet the requirements for the ignition protected type Ex e "increased safety" socket. A preferred embodiment of such contact springs is disclosed, for example, in German Patent No. 2,706,482.

Each of the two contact springs may be part of a clamping insert disposed in the receiving element and electrically connected with a terminal for an electrical lead.

The common actuating member for the contact springs is advantageously coupled with an adjustment device for the actuating device which, in simple cases, may be, for example, an adjustment screw. However, it is particularly advisable that the adjustment device be a Bowden cable which permits remote operation of the actuating device. This opens up the possibility of operating the actuating devices of a plurality of such sockets simultaneously and jointly, for example, in a lamp, as will be described in greater detail below.

In a preferred embodiment, the arrangement is such that the receiving element in the socket housing is mounted against the force of a spring which is axially displaceable within limits. This not only permits easy insertion of the fluorescent bulb, but simultaneously allows for automatic compensation of the length differences existing in conventional double-pin base fluorescent bulbs. The cylindrical receiving element may additionally be mounted in the socket housing so as to be rotatable within limits so that the fluorescent bulb can be rotated into the desired position, for example, in order to compensate for possible position tolerances of the socket pins. In principle, however, embodiments are also conceivable in which the receiving element is not displaceable in the socket housing but is merely rotatably mounted, in which case the socket pins can then be introduced into the insertion openings when the receiving element is in a defined rotary position.

The elongate locking element, which prevents improper insertion of the fluorescent bulb into the socket, lies in the receiving element in the region of the base face of an inserted fluorescent bulb and is displaceable against the force of a spring between an active position, in which it projects beyond the front face of the receiving element, and an inactive position, in which it is pushed into the receiving element. In its active position, the locking element thus holds the base of the fluorescent bulb at such a distance from the receiving element of the socket that the socket pins can reliably be prevented from coming in contact with voltage carrying parts of the electrical connecting means.

To determine the presence or absence and thus the proper position of the socket pins, differently configured sensing means are employed. However, structurally, it is particularly advantageous if the sensing means are constituted directly by the contact springs so that additional sensing devices are not needed. The actuating member, which is coupled with the two contact springs, may then be configured so that it is transferred by the spring force of the contact springs into a locking position in which it locks the locking element in its active position.

In a practical embodiment, the locking element is rigidly connected with an arresting member disposed in the receiving element and equipped with a detent device which cooperates with the actuating member and wherein the actuating member is guided in the receiving body so as to be movable in a direction transverse to the arresting member.

Finally, if necessary, measures may be taken to prevent the locking device from being intentionally bypassed by pressing the locking element back manually when no fluorescent bulb is inserted, then moving the clamping device to its operating state and, finally, attempting to force the socket pins into the closed clamping device. For this purpose, the socket may be provided with an anti-bypass type safety device for the locking device. This safety device is positively coupled to the clamping device and becomes effective when the clamping device is not released. This safety device may be configured so that the receiving element, with the actuating member in the locked position, is nondisplaceably held in the socket housing by the actuating member. This also prevents the above-described subsequent insertion of the fluorescent bulb after the clamping device has been closed, because the receiving element can no longer be pushed back into the socket housing to the extent that the socket pins could be inserted into their insertion openings when the clamping device is closed.

The above-described socket is particularly suitable for use in explosion protected lamps of the ignition protection type Ex e "increased safety". Such light fixtures are generally equipped with a fluorescent bulb cover which can be opened and include at least two of the above-mentioned sockets together with further, likewise explosion protected, components, e.g. starters of the ignition protected type "pressure tight encapsulation" Ex d, attachment devices of the ignition protected type "sand encapsulation" Ex q, or "increased safety" Ex e, each including terminal clamps of the ignition protected type "increased safety".

According to the present invention, such a lamp is configured so that the actuating devices of the two sockets are coupled with a central lock which is inaccessible if the cover is closed. For this purpose, it is advisable that the Bowden cables of the two sockets be coupled to the central lock with the lock including an actuating member which is mounted to be retrievable when the clamping devices are released and which keeps the cover in the open state.

When the cover is open, associated switching means make the sockets free of voltage as prescribed. Since the central lock is accessible only after the cover has been opened, it is thus ensured that the clamping devices for the sockets can be opened only when there is no voltage. At the same time, the central lock ensures that the clamping devices for all socket pins are released simultaneously and, more importantly, are also all clamped in simultaneously, thus making it impossible, if the fluorescent bulb is inserted properly, for one or several of the socket pins to inadvertently fail to be clamped in when voltage is again applied to the sockets.

One embodiment of the invention is illustrated in the drawings.

BRIEF DESCRIPTION OF THE DRAWINGS

FIG. 3 is a corresponding view of the socket of FIG. 1, showing its state when the clamping device is released and the locking element is manually pushed in.

DESCRIPTION OF THE PREFERRED EMBODIMENT

Figure 1:
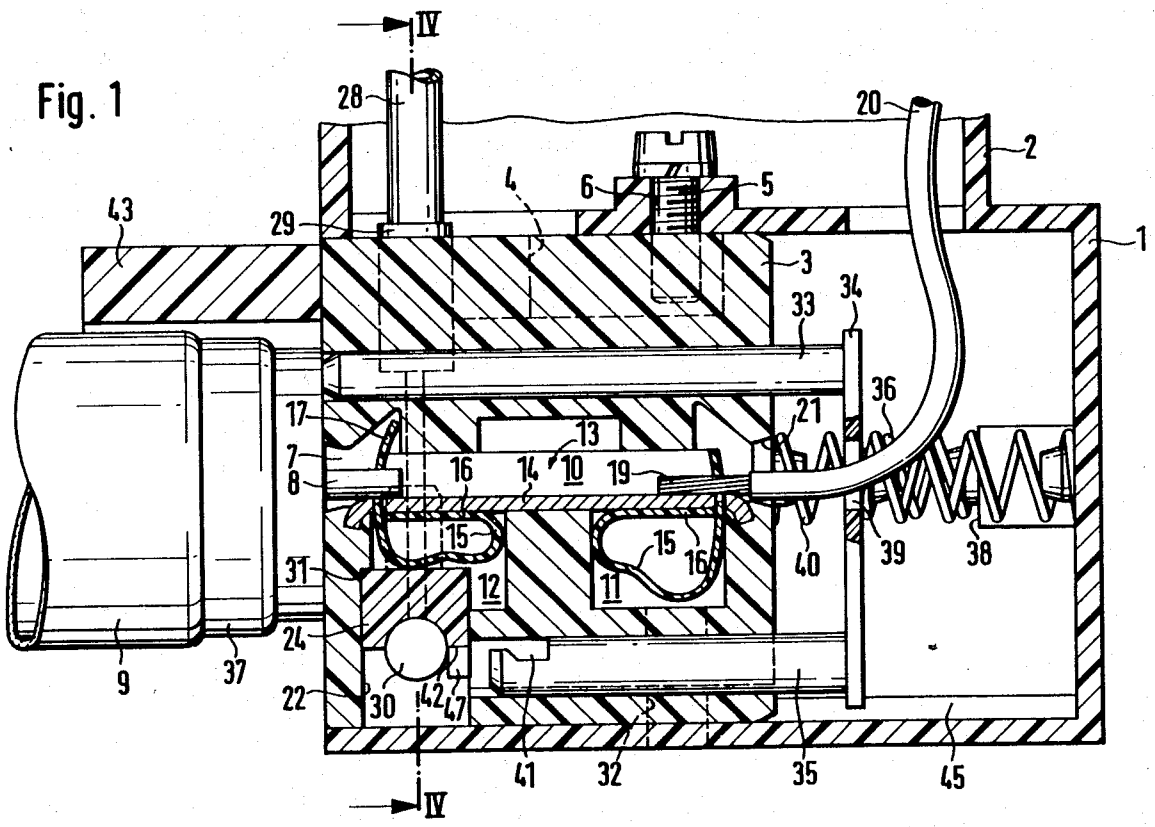
FIG. 1 is a sectional side view along line I—I of FIG. 4 from the side of an explosion protected socket according to the invention, showing the state with the fluorescent bulb inserted.

The explosion protected socket for double pin base fluorescent bulbs shown in FIGS. 1 to 6 has an essentially cylindrical socket housing 1 which may be fastened, by way of a base member 2 (FIG. 7), to a lamp or support. The plastic socket housing 1 includes a cylindrical receiving element 3 which is mounted so as to be longitudinally displaceable and has an open-edge groove 4 which limits its axial displacement path. A screw bolt 5, screwed into a corresponding threaded bore 6 provided in the wall of socket housing 1, projects into groove 4 and simultaneously acts as securing means against rotation. Two insertion openings 7 (FIG. 6) having rectangular cross sections for the two contact pins 8 of a double pin base fluorescent bulb indicated, for example, at 9 in FIG. 1, open at the front face of receiving element 3. Insertion openings 7 lead to two continuous, channel-like recesses 10 in receiving element 3 followed on the side by two chambers 11, 12. A self-locking clamping insert 13 is inserted into each recess 10 and its chambers 11, 12 to serve as part of a clamping device for socket pins 8.

Each clamping insert includes a metal contact rail 14 disposed in recess 10 and having an essentially U-shaped cross section as well as two contact springs 15 disposed in the two chambers 11 and 12. These contact springs are approximately heart-shaped in the manner of so-called cage tension springs. Each contact spring 15 is supported by means of an arm 16 at contact rail 14 and is electrically conductively connected therewith while its other arm 17 extends approximately at a right angle to contact rail 14 and projects through an opening in the bottom of the rail. Spring arm 17 has a continuous rectangular opening 18 (FIG. 6) which is equipped to receive either a contact pin 8 that is pushed through it or the blank end 19 of a flexible electrical lead 20 that is pushed therethrough. Contact springs 15 are tensioned in such a manner that they tend to pull their spring arms 17 and thus, opening 18, downward—with respect to FIG. 1. This causes a contact pin 8 or a conductor end 19, pushed through opening 18, to be pressed against contact rail 14, thus establishing a conductive connection, with the inner edge of opening 18 being supported on contact pin 8 or conductor end 19.

In this way, the two contact springs 15 ensure a perfect clamping connection with contact rail 14 in a manner secure against coming loose for a socket pin 8 or a conductor end 19 which is placed through opening 18.

As can be seen in FIG. 1, contact rail 14 is somewhat shorter than the length of receiving element 3; it ends at a predetermined distance from the two front faces of receiving element 3 and its inner bottom wall lies somewhat higher than the lower edge of socket pin insertion opening 7 which is flush therewith and somewhat higher than the oppositely disposed lead insertion opening 21 which is likewise flush with contact rail 14.

Contact springs 15 and contact rail 14 form the electrical connection means for contact pins 8 of fluorescent bulb 9 and the two leads 20.

Figure 4:
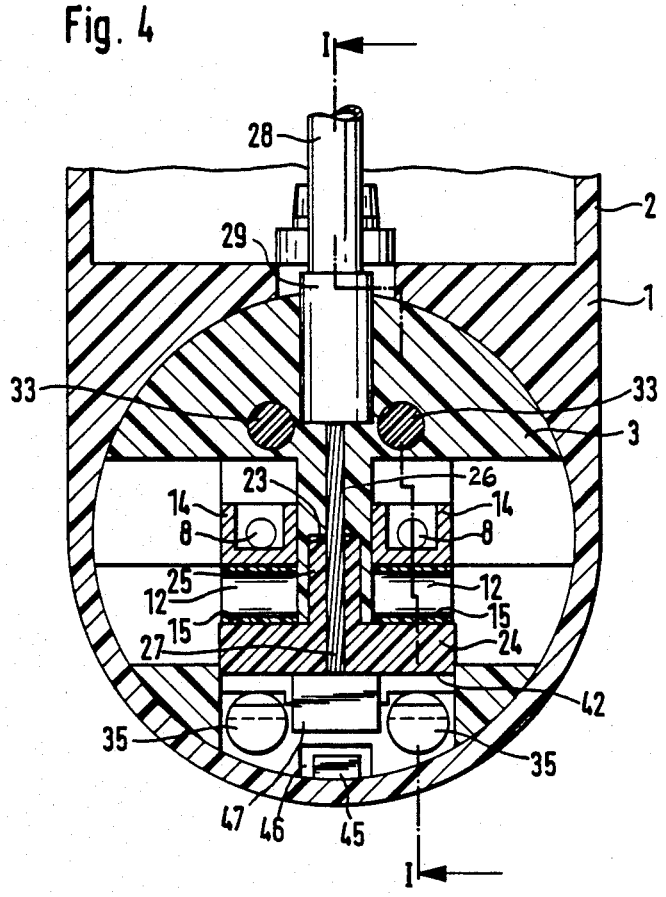
FIG. 4 is a sectional side view along line IV—IV of FIG. 1 of the socket of FIG. 1.

In the region of the two chambers 11, 12, receiving element 3 is provided with a rectangular, transverse recess 22 which has an open edge into which opens a guide bore 23 which can be seen in FIG. 4, and which is disposed centrally between the two chambers 11, 12. An essentially L-shaped actuating member 24 which is adjustable in height with respect to FIG. 1 is guided in recess 22 and has a guide pin 25 which engages in bore 23. This actuating member 24 is connected with the steel cable 27 of a Bowden cable 28 passing through a corresponding coaxial bore 26 of receiving element 3. The outer sheath 29 of Bowden cable 28 is inserted into a corresponding cylindrical recess in receiving element 3. To connect steel cable 27 with actuating member 24, a cylindrical transverse bolt 30 is provided which engages in a corresponding recess having an approximately semicircular cross section and being provided at the underside of actuating member 24. Steel cable 27 is fastened to this transverse bolt 30.

The two contact springs 15 associated with socket pins 8 are supported on actuating member 24 in the manner shown in FIGS. 1 to 3, with the relaxed state of contact springs 15 being shown in FIG. 3, in which, with socket pin 8 not pushed through, opening 18 lies below the bottom of contact rail 14, while actuating member 24 is pushed completely downwardly in receiving element 3 by the tension of contact springs 15.

In the tensioned state of Bowden cable 28, as shown in FIG. 1, actuating member 24 is pulled upward until it abuts at a stop 31, thus lifting the bores of spring arms 17 of the two associated contact springs 15 higher than the bottom of contact rail 14 so that socket pins 8 of fluorescent bulb 9 can be introduced unimpededly through insertion openings 7.

Figure 5:
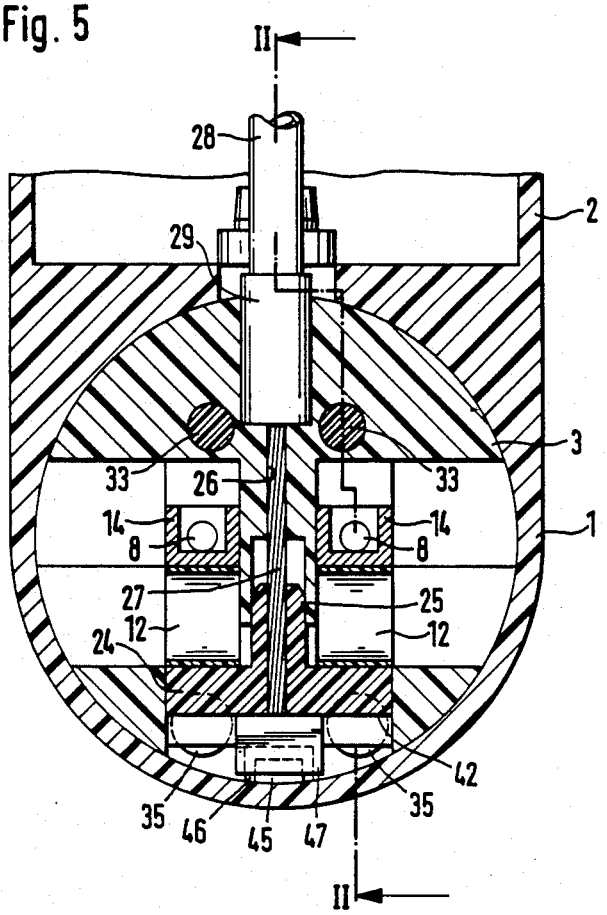
FIG. 5 is a sectional view corresponding to FIG. 4 of the socket according to FIG. 2.
Figure 6:
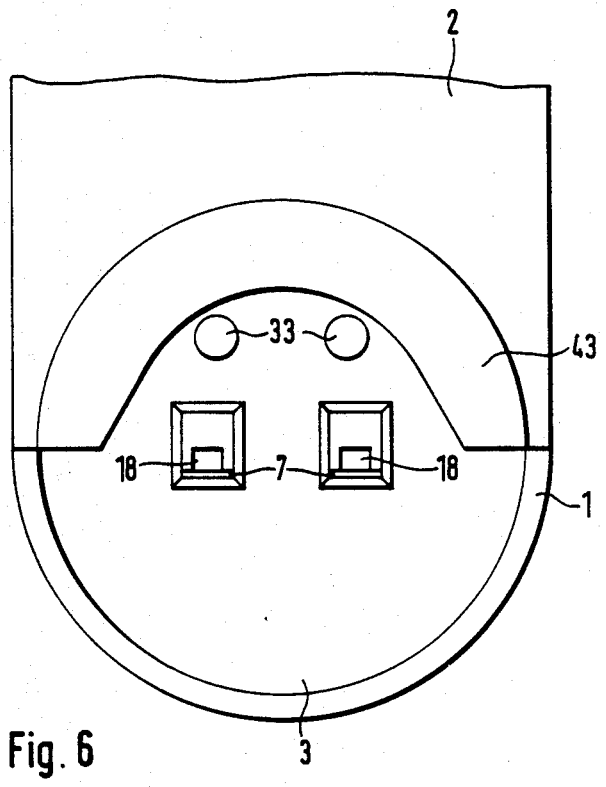
FIG. 6 is a front view of the insertion openings for the socket pins of the socket of FIG. 1.

Since the two contact springs 15 associated with socket pins 8 are supported on actuating member 24 in the manner shown in FIGS. 4 and 5, these springs are simultaneously tensioned or relaxed when Bowden cable 28 is actuated.

Figure 2:
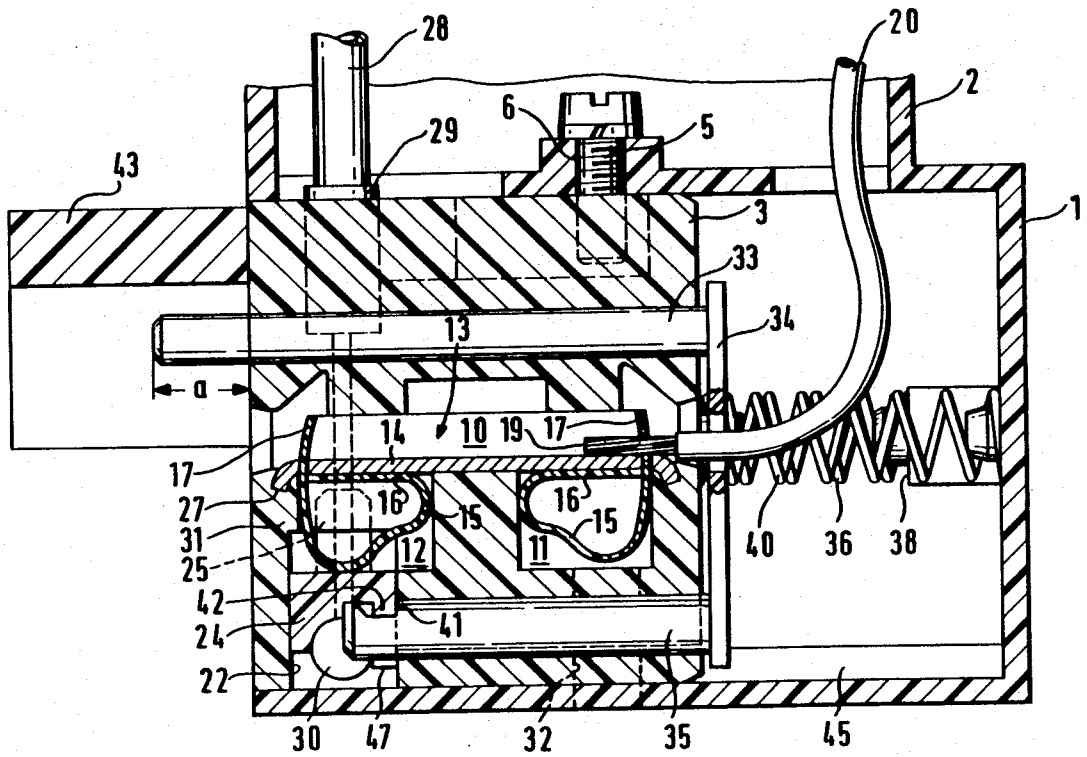
FIG. 2 is a corresponding view of the socket according to FIG. 1, showing the state in which the locking element is in the locked position.

Actuation of contact springs 15 associated with lead ends 19 is effected by means of a tool, for example a screwdriver, which is inserted from the outside through an associated operating opening in receiving element 3 and in socket housing 1 as shown at 32 in FIG. 2.

Two locking elements in the form of two cylindrical locking bolts 33 are mounted in receiving element 3 above insertion openings 7 so as to be longitudinally displaceable. At their end disposed in socket housing 1, these locking bolts 33 are rigidly connected by way of a plate 34 with one another as well as to two parallel arresting bolts 35 which are disposed below contact rails 14 and which are likewise longitudinally displaceable.

The free ends of locking bolts 33 lie within the outline of base 37 of a fluorescent bulb 9 whose contact pins 8 are aligned with insertion openings 7; they are displaceable in receiving element 3 between an inactive position (FIG. 1) in which they are pushed fully into receiving element 3 and an active position (FIG. 2) in which they project by a distance a beyond the front face of receiving element 3. The distance a is selected so that, with fluorescent bulb base 37 lying against the front face of the locking bolt, which is in the active position as shown in FIG. 2, the contact pins 8 of the fluorescent bulb are spaced at a predetermined safety distance from voltage carrying parts of the electrical connecting device, i.e. from spring arms 17 associated with contact pins 8 and from contact rail 14.

Locking bolts 33 are pretensioned into their active position (FIG. 2) by a compression spring which engages at plate 34 with its other end being supported at 38 at the bottom of socket housing 1. At the same time, receiving element 3 is pretensioned by a second compression spring 40 which is disposed next to an opening 39 in plate 34 for the passage of the electrical lead 20, the pretensioning being toward the left, with reference to FIGS. 1 to 3, into a position in which the front face of receiving element 3 is flush with the front face of socket housing 1.

In the vicinity of their free ends, each of the two arresting bolts 35 has a detent recess 41 into which a detent lug 42, in the form of a strip formed at actuating member 24, is engageable when the latter has been raised.

The socket described above operates as follows:

Starting from the rest position shown in FIG. 2, a double base fluorescent bulb 9 is to be inserted into the socket. In the illustrated rest position, Bowden cable 28 is untensioned; actuating member 24 is therefore pressed downwardly under the force of the tension of the two contacting contact springs 15, while compression spring 36 has moved arresting bolts 35 and locking bolts 33 to the left with respect to receiving element 3 so that locking bolts 33 are in their active position. Detent lugs 42 of actuating member 24 engage in detent recesses 41 of arresting bolts 35, thus locking the locking bolts by way of plate 34 in their active position. Thus locking bolts 33 effectively prevent the insertion of socket pins 8 of a fluorescent bulb 9 into insertion openings 7.

Starting with this rest position, Bowden cable 28 is initially tensioned, thus causing actuating member 24 to move upward until it reaches the position defined by stop 31 as shown in FIG. 1. In this position of actuating member 24, detent lugs 42 have been lifted out of detent recesses 41 of arresting bolts 35, while at the same time the spring arms 17 associated with socket pins 8 have been raised to such an extent that their openings 18 are flush with insertion openings 7 for socket pins 8.

In this position, socket pins 8 of fluorescent bulb 9 can now be inserted into insertion openings 7, and the now unlocked locking bolts 33 are simultaneously moved to the right against the force of compression spring 36, with reference to FIG. 2, into their inactive position. A guide 43 having a circular segment shaped cross section is arranged at the front face of socket housing 1 or of receiving element 3 and covers base 37 when fluorescent bulb 9 is inserted. It thus facilitates the introduction of contact pins 8 in the correct position.

Bowden cable 28 is now relaxed with the result that contact springs 15 associated with actuating member 24 are released and their spring arms 17 are able to move downwardly with reference to FIG. 1. Since socket pins 8 of fluorescent bulb 9, if the latter is inserted properly, project through the openings of spring arms 17, the edges of the openings of these spring arms finally lie on the inserted socket pins 8, thus pressing socket pins 8 against contact rail 14, and are clamped to contact rail in a manner secure against coming loose, thus producing proper electrical contact conditions.

For the case now where fluorescent bulb 9 has not been inserted properly, for example if its socket pins 8 were not inserted far enough into insertion openings 7 or were placed only onto the front face of receiving element 3, socket pins 8 do not project through openings 18 in spring arms 17. Once Bowden cable 28 is relaxed, spring arms 17, which act as sensing members, are thus not prevented by socket pins 8 from performing their downwardly oriented movement, with reference to FIG. 1, with the result that contact springs 15 are able to push actuating member 24 completely downwardly into the position shown in FIG. 2. The fact that no contact pins engage in openings 18 of spring arms 17 indicates that base 37 of fluorescent bulb 9 is disposed at too great a distance from the front wall of receiving element 3 and locking bolts 33 are also not pressed back into their inactive position (FIG. 1). The detent lugs 42 of the downwardly moving actuating member 24 therefore engage in the detent recesses 41 of arresting bolt 35, thus locking locking bolts 33 securely fixed in their active position (FIG. 2).

This makes it impossible to subsequently introduce socket pins 8 into insertion openings 7 to the extent that they could come in contact with voltage carrying parts. Rather, Bowden cable 28 must first be operated again to permit insertion of socket pins 8.

It would be conceivable in principle to intentionally bypass the lock for the socket, effective in the described manner in the form of locking bolts 33, in that, with Bowden cable 28 tensioned, i.e. starting from the position of FIG. 1, locking bolts 33 are held manually in their inserted ineffective position, with fluorescent bulb 9 removed from the socket, and Bowden cable 28 is then untensioned. This would have the result that, when the Bowden cable is relaxed—and no contact pins 8 are present in openings 18 of spring arms 17—contact springs 15 would press actuating member 24 into the position shown in FIG. 3 in which, however, detent lugs 42 do not come into engagement with detent recesses 41 because arresting bolts 35 have been shifted to the right by way of rightward movement of locking bolts 33.

The consequence would be that, with a socket circumvented in this way, contact pins 8 could now be introduced into insertion openings 7 to such an extent that they could come in contact with voltage carrying parts, i.e. with contact rails 14 or spring arms 17, and could thus produce sparks. To prevent this, a separate anti-bypass device is provided.

Figures 7, 8:
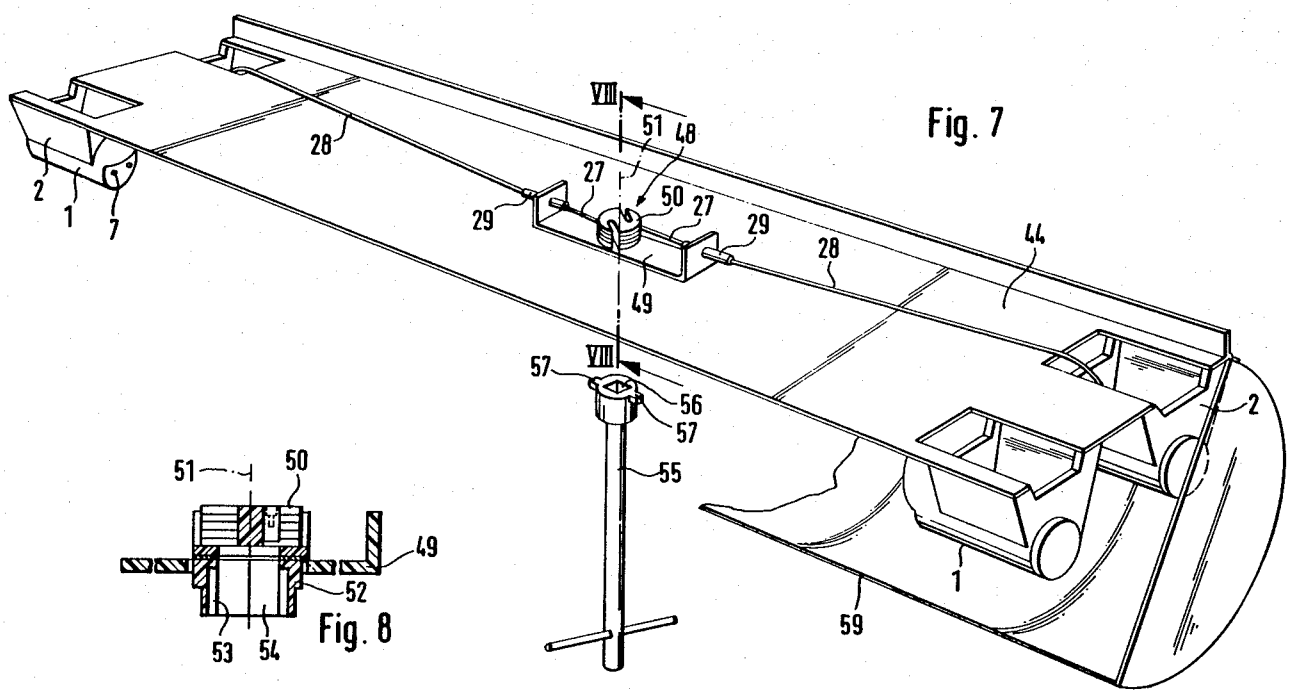
FIG. 7 is a schematic, perspective representation of a lamp according to the invention.
FIG. 8 is a sectional side view along line VIII—VIII of FIG. 7 of the lamp of FIG. 7 to a different scale.

The two socket housings 1 associated with a fluorescent bulb 9 are fastened, for example, to the light fixture 44 shown in FIG. 7 or to a wall or the like at a distance corresponding precisely to the length of fluorescent bulb 9 measured between the two base front faces. Because of the projecting contact pins 8, fluorescent bulb 9 can therefore be inserted into the sockets only in such a way that one of receiving elements 3 is pushed back against the force of the second compression spring 40 to the extent that socket pins 8 can be inserted into socket housing 1 of the oppositely disposed socket.

In the interior of each socket housing 1 there is now provided an axially parallel longitudinal rib 45 (FIGS. 4 and 5) which engages in a guide groove 46 of receiving element 3 and produces a longitudinal guide therefor while securing it against rotation. Longitudinal rib 45 is shorter than socket housing 1 and its front face ends flush with the inner wall of recess 22. Moreover, a tongue-like stop 47 is formed on actuating member 24 which projects downward, with reference to FIGS. 1 to 3, and lies between arresting bolts 35, oriented toward longitudinal rib 45.

Figure 3:
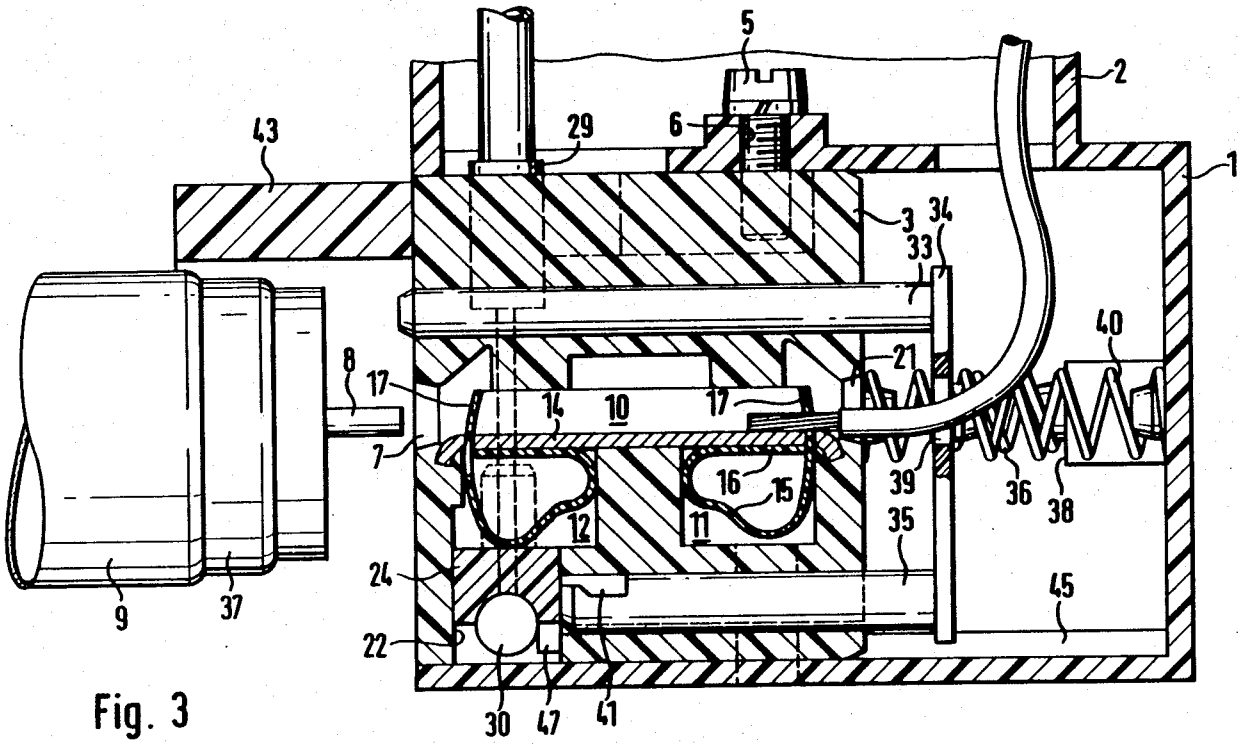

If, therefore, in an attempt a bypass, locking bolts 33 are pushed into the inactive position according to FIG. 3, with Bowden cable 28, tensioned and then Bowden cable 28 is relaxed, contact springs 15, as already mentioned, push actuating member 24 downward with reference to FIG. 3. Since this would not bring detent lugs 42 of actuating member 24 in engagement with detent recesses 41 of arresting bolts 35 and thus actuating member 24 would not be stopped in its downward movement, contact springs 15 are able to move actuating member 24 into the position shown in FIG. 3, which is lower than the position of FIG. 2, and in this position abutment 47 would pass over the front end of guide rib 45. This means that receiving element 3 in socket housing 1 is locked in a manner whereby it cannot be displaced. Thus it is no longer possible to insert a fluorescent bulb 9 into the two sockets.

A light fixture equipped with two of the described sockets is shown in FIG. 7 in which Bowden cables 28, for the sake of clarity, are shown only for one pair of socket housings 1. As already mentioned, the two socket housings 1 are fastened to the ends of lamp body 44. Their Bowden cables 28 are brought to a central lock 48 which is disposed approximately in the center between the two socket housings 1 on the side of lamp body 44 facing away from the socket housings so that, with the lamp fastened to the ceiling etc., the lock is not accessible from the top. This central lock 48 includes a U-shaped bar 49 which is fastened to lamp body 44 and which also has an essentially U-shaped cross section. The sheaths 29 of the two Bowden cables 28 are supported at the two flanges of bar 49 while the associated steel cables 27 are brought through respective bores in the bar arms to an essentially cylindrical actuating disc 50 and are anchored there at two opposed positions on its circumference. Actuating disc 50 is mounted at lamp body 44 so as to be rotatable about an axis 51 shown in FIG. 8. The disc includes an associated tubular key stud 52 which is fastened to lamp body 44 and is provided in the region of its front face with grooves 53 in the manner of a bayonet lock. An actuating square 54, formed on actuating disc 50, projects into this key stud 52.

A specially shaped key 55 is required to rotate actuating disc 50 and thus tension or relax the two Bowden cables 28. This key is provided at its end with a key insertion opening 56 having a square cross section and corresponding to actuating square 54 where two outwardly projecting locking lugs 57 are disposed which cooperate with grooves 53 of key stud 52 in the manner of a bayonet lock.

Finally, a hood-shaped cover 59 is articulated to one side of lamp body 44. This cover is made of a transparent material and, when closed, covers fluorescent bulb 9 in such a manner that the requirements for "increased safety" of ignition protection type Ex e are met. That means, inter alia, that an electrical switch (not shown in FIGS. 7 and 8) is disposed in covering hood 59 so as to ensure, when hood 59 is opened, that the two sockets are free of voltage. Key 55 can be inserted into key stud 52 only if covering hood 59 is open, which means that the clamping device for socket pins 8 in both sockets can be released via the two Bowden cables 28 only after the electrical connecting means in these sockets have become free of voltage. With Bowden cables 28 tensioned, i.e. with the clamping device 41,42 unlocked in both sockets, key 55 is in an angular position in key stud 52 in which it cannot be removed from key stud 52 due to the bayonet lock 53/57. The downwardly projecting key 55 thus prevents closing of covering hood 59 when the clamping device of both sockets is released. Only if Bowden cables 28 are released, i.e. contact springs 15 are released by actuating member 24, is key 55 in an angular position in which it can be removed from key stud 52 whereby it is possible to bring covering hood 59 into its closed position and simultaneously switch on the voltage supply for the two sockets.

Screw bolt 5 and guide rib 45 essentially hold receiving element 3 in socket housing 1 so that it cannot be rotated. However, it may be advisable to permit receiving element 3 to be rotatably movable within limits in socket housing 1 to thus be able to rotate fluorescent bulb 9 somewhat after it has been inserted into the sockets. This limited rotational mobility is realized in the present case in that the groove 4 which receives screw bolt 5 has a greater width than corresponds to the diameter of screw bolt 5 while, on the other hand, guide rib 45 is received in its associated guide groove 46 with greater lateral play.

The invention now being fully described, it will be apparent to one of ordinary skill in the art that many changes and modifications can be made thereto without departing from the spirit or scope of the invention as set forth herein.

The present disclosure relates to the subject matter disclosed in German Application No. P 36 21 960.6 of July 1st, 1986, the entire specification of which is incorporated herein by reference.

We claim:

1. A socket for double socket pin base fluorescent bulbs, said socket having a secure clamping device which will not come loose from bulb socket pins and which has electrical connecting means associated therewith, comprising:

(a) a socket housing, (b) a receiving element having insertion openings therein for receiving socket pins from a fluorescent bulb disposed in said socket housing, (c) said socket housing having electrical connecting means mounted therein and movable therein;

(d) clamping means in said housing for clamping the socket pins, (e) actuating means for controlling operation of said clamping means, and (f) locking means responsive to predetermined operation of said actuating means and including at least one locking element movable form an active to an inactive position, said locking means, in the active position, preventing contact of said socket pins with said electrical connecting means.

2. The socket as defined in claim 2, wherein said receiving element is mounted in said socket housing and is axially movable within limits therein, and in said housing, and spring means to apply a force against said receiving element.

3. The socket as defined in claim 1, wherein said receiving element is cylindrical.

4. The socket as defined in claim 1, wherein said locking means is mounted in said receiving element and is positionable to be displaceable against the force of a spring between an active position in which it projects outwardly from said receiving element and an inactive position in which it is pushed into said receiving element.

5. The socket as defined in claim 1, further including an anti-bypass device for the locking device, said anti-bypass device being positively coupled with the clamping device and being effective if the clamping device is released.

6. The socket as defined in claim 1, wherein said socket is an explosion protected socket.

7. The socket as defined in claim 1, wherein the clamping means includes a pair of contact springs, said contact springs forming part of said electrical connecting means and serving, when in the operating state, to clamp socket pins in position, said contact springs being coupled to a common actuating member of said actuating means.

8. Socket as defined in claim 7, further including adjustment means coupled to said actuating means.

9. Socket as defined in claim 8, wherein said adjustment means is a Bowden cable.

10. The socket as defined in claim 9, wherein said receiving element is mounted in said socket housing and is axially movable within limits therein, and in said housing spring means to apply a force against said receiving element.

11. The socket as defined in claim 10, wherein said receiving element is cylindrical.

12. The socket as defined in claim 11, wherein said locking means is mounted in said receiving element and is positionable to be displaceable against the force of a spring between an active position in which it projects outwardly from said receiving element and an inactive position in which it is pushed into said receiving element.

13. The socket as defined in claim 11, wherein the locking element is rigidly connected with an arresting member disposed in the receiving element, said arresting member being provided with detent means which cooperate with said actuating means and the actuating means being guided so as to be movable in the receiving element transversely to said arresting member.

14. The socket as defined in claim 7, wherein sensing means responsive to the position of said socket pins with respect to said clamping means are formed by said contact springs.

15. The socket as defined in claim 14, wherein the locking element is rigidly connected with an arresting member disposed in the receiving element, said arresting member being provided with detent means which cooperate with said actuating means and the actuating means being guided so as to be movable in the receiving element transversely to said arresting member.

16. The socket as defined in claim 14, wherein the actuating means is coupled to the two contact springs and is configured so as to be movable by the force of said contact springs into a locking position in which it locks the locking means in its active position.

17. The socket as defined in claim 16, wherein, if the actuating member is in the locked position, the receiving element is undisplaceably held in the socket housing by the actuating member.

18. The socket as defined in claim 16, wherein the locking element is rigidly connected with an arresting member disposed in the receiving element, said arresting member being provided with detent means which cooperate with said actuating means and the actuating means being guided so as to be movable in the receiving element transversely to said arresting member.

19. The socket as defined in claim 18, further including an anti-bypass device for the locking device, said anti-bypass device being positively coupled with the clamping device and being effective if the clamping device is released.

20. The socket as defined in claim 19, wherein, if the actuating member is in the locked position, the receiving element is undisplaceably held in the socket housing by the actuating member.

21. A lamp, comprising:

a lamp body, a pair of sockets, for receiving socket pins from a fluorescent lamp, secured to said lamp body, a fluorescent bulb cover secured to said lamp body, said cover having an open and a closed position, respective clamping means included in each socket for clamping socket pins, respective actuating means for controlling operation of said clamping means, and lock means, accessible only when said cover is in said open position to provide access thereto, for simultaneously controlling said actuating means of both of said sockets.

22. The lamp as defined in claim 21, wherein said actuating means include respective Bowden cables, said cables of the pair of sockets being coupled to said lock means, said lock means having an actuating member which, when engaged, prevents the cover from being closed from its open position.

23. The lamp as defined in claim 21, wherein said socket is an explosion protected socket.

* * * * *